US006655679B2

(12) United States Patent
Boucher et al.

(10) Patent No.: US 6,655,679 B2
(45) Date of Patent: Dec. 2, 2003

(54) INPUT CONVERGER FOR HARDCOPY DEVICES

(75) Inventors: Peter Boucher, Vancouver, WA (US); Vance M. Stephens, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 30 days.

(21) Appl. No.: 10/062,996

(22) Filed: Jan. 31, 2002

(65) Prior Publication Data

US 2003/0141657 A1 Jul. 31, 2003

(51) Int. Cl.[7] ..... B65H 3/06; B65H 5/00; B65H 9/04

(52) U.S. Cl. ..... 271/119; 271/10.09; 271/10.12; 271/242; 271/9.01; 271/9.11; 271/9.13

(58) Field of Search ..... 271/119, 10.12, 271/242, 9.01, 9.11, 9.13, 4.01, 4.08, 4.07, 10.01, 10.09, 10.11, 109; 399/391; 221/130; B65H 5/22, 5/00, 3/06, 9/04, 3/44

(56) References Cited

U.S. PATENT DOCUMENTS

| | | | | |
|---|---|---|---|---|
| 4,598,298 A | | 7/1986 | Groenke et al. | |
| 4,779,861 A | * | 10/1988 | Ozawa et al. | 271/119 |
| 5,775,684 A | | 7/1998 | Jackson et al. | |
| 5,954,328 A | * | 9/1999 | Hatanaka | 271/119 |
| 6,050,565 A | | 4/2000 | Fetherolf | |
| 6,070,867 A | * | 6/2000 | Tsurumi et al. | 271/114 |

* cited by examiner

*Primary Examiner*—Donald P. Walsh
*Assistant Examiner*—Kenneth W. Bower

(57) ABSTRACT

Apparatus for advancing media through a hardcopy device includes a cylindrical guide wheel having a first radius mounted on a shaft having an axis transverse to a media feed path axis. A guide surface is spaced apart from the guide wheel and defines a media feed path between the guide wheel and the guide surface. A drive wheel having an extended portion that is concentric with the guide wheel, and which has a greater radius than the first radius is fixed to the shaft. A pinch roller communicates with the media feed path.

32 Claims, 5 Drawing Sheets

58
50
56
66
74
70
68
18
64
D
E
26
42
41
31
R1
52
36
72
60
28
R2
30
43
44,48
32
46
B
54
34
24
A
34
20
62
C 56
43
50
76
66
74
70
68
18
64
D
60
32
R2
58
31
52
30
F
72
E
R1
41
26
44,48
46
B
54
24
20
62
34
C

INPUT CONVERGER FOR HARDCOPY DEVICES

TECHNICAL FIELD

This invention relates to hardcopy devices, and more particularly to an input converger for accurate control of media movement therethrough.

BACKGROUND OF THE INVENTION

Hard copy devices process images on media, typically taking the form of scanners, printers, plotters (employing inkjet or electron photography imaging technology), facsimile machines, laminating devices, and various combinations thereof, to name a few. These hardcopy devices typically transport media in a sheet form from a supply of cut sheets or a roll, to an interaction zone where scanning, printing, or post-print processing, such as laminating, overcoating or folding occurs. Often different types of media are supplied from different supply sources, such as those containing plain paper, letterhead, transparencies, pre-printed media, etc.

The relative position of the paper and the operative structures in the interaction zone is precisely maintained to effect high-quality media processing in the interaction zone. For example, in the case of an inkjet printer, printing occurs in the interaction zone and the position of an ink cartridge as it reciprocates in a back and forth motion across the media, and the positioning and control of paper as it advances past the printheads in the ink cartridge are controlled to produce high quality images. The media advancement through the hardcopy devices, and the positioning of the operators in the interaction zone are typically separately controlled, although their operation is coordinated with a hardcopy controller.

Hardcopy apparatus typically include media advancement mechanisms that serve to advance the recording media from one or more media sources through a media feed path and through the interaction zone. Again in the case of an inkjet printer, the interaction zone is typically a "printzone" where ink is applied to the paper. The media advance mechanisms move the paper through the interaction zone the desired distance, often in incremental steps, at the desired rate, and in a manner such that the media is oriented correctly relative to the devices found in the interaction zone. Achieving high quality media processing is often impeded by media feed errors such as overfeeding and underfeeding, and misalignment errors such as skewing.

SUMMARY

The illustrated embodiment relates to apparatus for advancing media through a hardcopy device. A cylindrical guide wheel having a first radius is mounted on a shaft having an axis transverse to a media feed path axis. A guide surface is spaced apart from the guide wheel to define a media feed path therebetween. A drive wheel having an extended portion that is concentric with the guide wheel, and which has a greater radius than the first radius is fixed to the shaft. A pinch roller communicates with the media feed path.

BRIEF DESCRIPTION OF THE DRAWINGS

FIGS. 5 through 7 are a sequential series of cross sectional views taken along the line 5—5 of FIG. 2 and illustrating a sheet of media in various positions as it is advanced through the input converger and printer and along a media feed path, with:

FIG. 5 showing a sheet of media as it is first engaged by the roller assembly;

FIG. 6 showing the next sequential step from FIG. 5, illustrating the media forming a buckle as a media leading edge enters a pinch between the linefeed roller and an associated linefeed wheel; and FIG. 7 showing the next sequential step from FIG. 6, where the roller assembly is in a home position and the media is advancing through the printer.

DETAILED DESCRIPTION OF PREFERRED EMBODIMENTS

Figure 1:
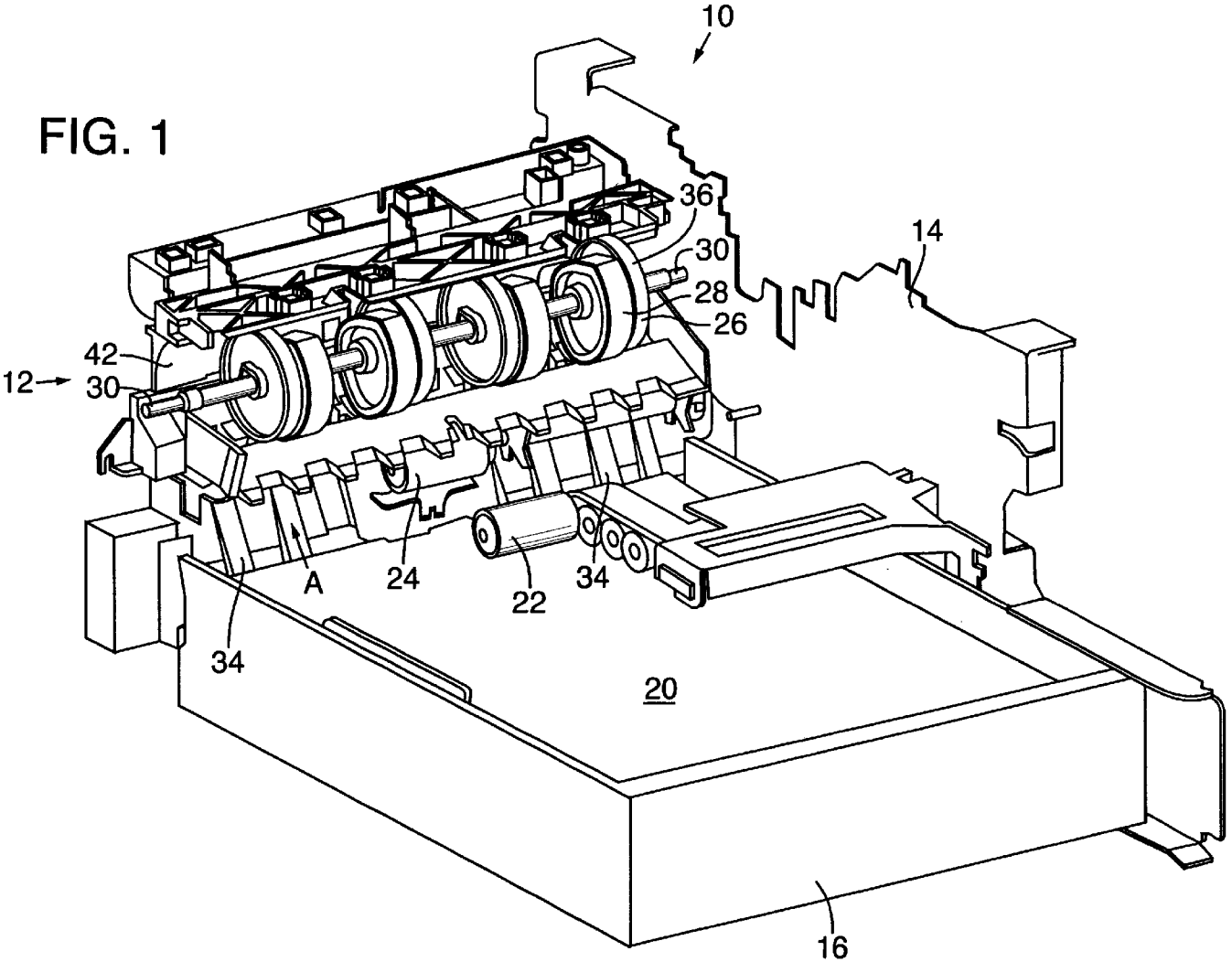
FIG. 1 is a semi-schematic perspective view of selected portions of a hardcopy device, here for the purposes of illustration shown as an inkjet printer illustrating an input converger assembly according to one embodiment the present invention housed in a printer chassis.

Most inkjet printers include a carriage that holds one or more ink-filled print cartridges. The carriage reciprocates in a back and forth motion across the printing surface, positioning the ink cartridge or cartridges adjacent the media, such as paper, for printing. During the printing operation the carriage is shuttled across the paper and minute ink droplets are ejected out of the cartridge onto the paper in a controlled manner to form a swath of an image each time the carriage is scanned across the page. Between carriage scans, the paper is advanced with a media feed assembly so that the next swath of the image may be printed. Sometimes, more than one swath is printed before the paper is advanced. In some printers, a stationary printhead or array of printheads may be provided as a page-wide-array ("PWA") printhead or print bar, extending across the entire width of the paper that moves through the printer.

The relative position of the print cartridge(s) and paper is precisely maintained to effect high-resolution, high-quality printing. The position of the print cartridge as it reciprocates in a back and forth motion across the media, and the positioning and control of paper advancement past the printhead are usually separately controlled, although their operation is coordinated with a printer controller.

Paper advancement assemblies typically include friction rollers or tractor feed mechanisms that advance the recording media from one or more media trays through a "printzone" where ink is applied to the paper. With an inkjet printer, in the course of advancing the print media between swaths, an encoder, typically a disk encoder, and associated servo systems are one of the methods often employed for controlling the precise incremental advance of the media. This incremental advance is commonly called "linefeed." Precise control of the amount of the advance, the linefeed distance, contributes to high print quality. As such, the structures that are used to advance the media are designed to minimize linefeed errors such as overfeeding and underfeeding, and misalignment errors such as skewing.

The paper advance mechanisms must move the paper through the printzone the desired distance with each incremental advance, at the desired rate, and so that the paper is oriented correctly relative to the printheads. There are several common printer problems that result from the failure to control these factors. As noted, these include linefeed errors and paper alignment errors. Overfeeding occurs when the linefeed roller incrementally advances the media too far relative to the printhead. On the other hand, underfeeding occurs when the paper has not advanced far enough. The result in either case is that ink is deposited in the wrong place on the paper, decreasing print quality. Skewing problems are caused by relative misalignment between the paper and the printheads. Ideally, the axis of media advancement should be perpendicular to the axis along which the printheads reciprocate. Stated in another way, the entire leading edge of a sheet of paper should enter the linefeed at the same time rather than being angled with respect to it. When the paper advances through the printzone in any orientation other than the ideal, the paper is skewed and the quality of the print job decreases.

Likewise, the position of the carriage as it reciprocates in a direction transverse to the direction that the paper is fed through the printer is also precisely controlled. Typically, the carriage assembly includes an optical sensor or encoder carried on the carriage positioned to view or read an encoder strip that extends laterally across the printer. A servo system is used in concert with the encoder and encoder strip to precisely control the position of the carriage relative to the media—typically by moving the carriage along a carriage shaft with a continuous drive belt.

The printer microprocessor controls and synchronizes both the reciprocating movement of the carriage, and the linefeed so that ink is deposited in a desired manner on the media.

The semi-diagrammatic illustration of FIG. 1 shows pertinent portions of a hardcopy device, illustrated for purposes herein as a representative inkjet printer 10 in which an illustrated embodiment of an input converger assembly according to the present invention may be used. For purposes of clarity and to illustrate the invention more clearly, many features of the printer structure and chassis are omitted from the figures. Although the invention is illustrated with respect to its embodiment in one specific type of printer, the invention may be embodied in numerous different types of printers and recorders.

Figure 2:
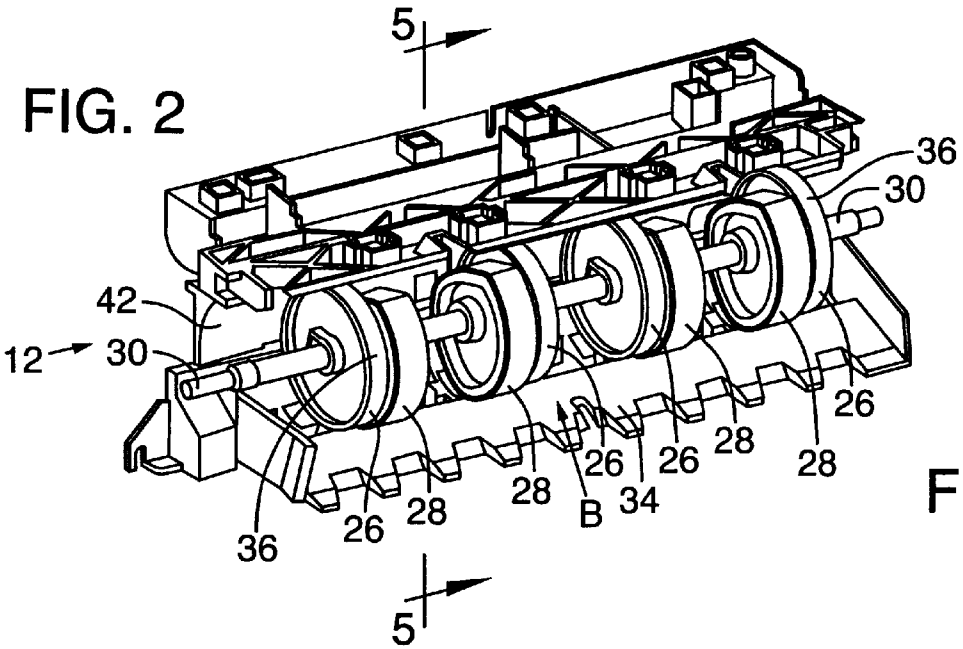
FIG. 2 is a semi-schematic perspective view of the input converger of FIG. 1, with major portions of the chassis and associated structure removed to illustrate the input converger more clearly.

Referring to FIGS. 1 and 2, inkjet printer 10 includes an input converger assembly, identified generally with reference number 12, mounted in a chassis 14 in an operative position to receive recording media, such as individual sheets of paper in the illustrated embodiment from a lower paper tray 16. As noted, many structural features in the printer are omitted from the drawings to clearly illustrate the invention. For example, printer 10 includes an inkjet cartridge(s) (not shown) and associated hardware mounted on a shaft for reciprocating movement past the media and along an axis that extends transverse to the media feed axis, which is defined as the axis of media travel as the media is fed through a printzone 18 (see FIG. 5). The media feed axis is perpendicular to the shaft axis. The inkjet cartridges are typically mounted to the chassis by conventional means such as a carriage assembly. The particular chassis 14 shown in the figures is used for illustration only, and is exemplary of the many different types of chassis assemblies that are used in printers of the type with which the present invention may be used. The chassis would of course be mounted in a printer housing and numerous other parts would be included in the complete printer.

Figure 6:
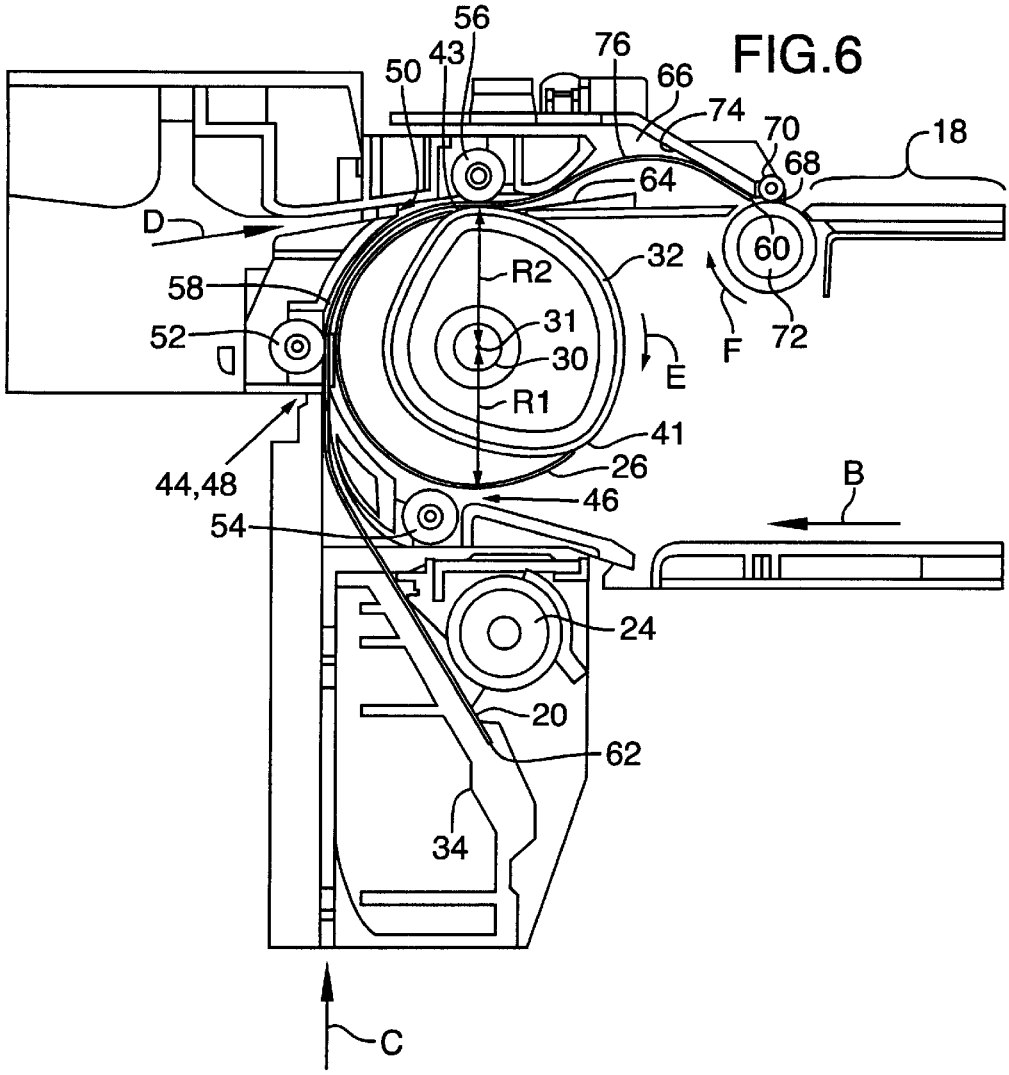

The carriage assembly supports the inkjet cartridges above print media, such as a sheet of paper 20 (FIG. 6). A media interaction head, here, such as a conventional printhead (also not shown) may be attached to the inkjet printer on the underside of the cartridge. The printhead may be conventional, and typically is a planar member having an array of nozzles through which ink droplets are ejected. The cartridge is supported by and movable on a shaft so that the printhead is precisely maintained at a desired spacing from the paper 20 at the printzone 18.

The carriage assembly may be driven in a conventional manner with a servo motor and drive belt, neither of which are shown, but which are under the control of the printer controller. The position of the carriage assembly relative to print media 20 is determined by way of an encoder strip that is mounted to the printer chassis in a conventional manner and extends laterally across the media, parallel to the shaft on which the inkjet carriage may be mounted. The encoder strip extends past and in close proximity to an encoder or optical sensor carried on the carriage assembly to thereby signal to the printer controller the position of the carriage assembly relative to the encoder strip. In most instances, the optical encoder carried on the carriage assembly encircles the encoder strip.

For other hardcopy devices, such as scanners and facsimile machines and the like, the printer cartridge may be replaced with another type of media interaction head, such as a scan head, which reads images previously recorded on media. Other interaction heads may, for example, apply overcoats or laminations to the media.

As described in greater detail below, input converger assembly 12 is supported by a chassis 14 and is configured to receive print media from a selected one of several sources, each of which supplies media to the assembly from a different direction. Among other functions, the converger assembly receives the media from these various sources and presents the media to a single media feed path through the printzone. For each media source that is included in printer 10 there is a separate media guide path defined from the media source to the input converger. Referring to FIG. 1, the media sources illustrated herein include lower paper tray 16, which defines a first guide path labeled with arrow A (and referred to herein as media path A).

Figure 5:
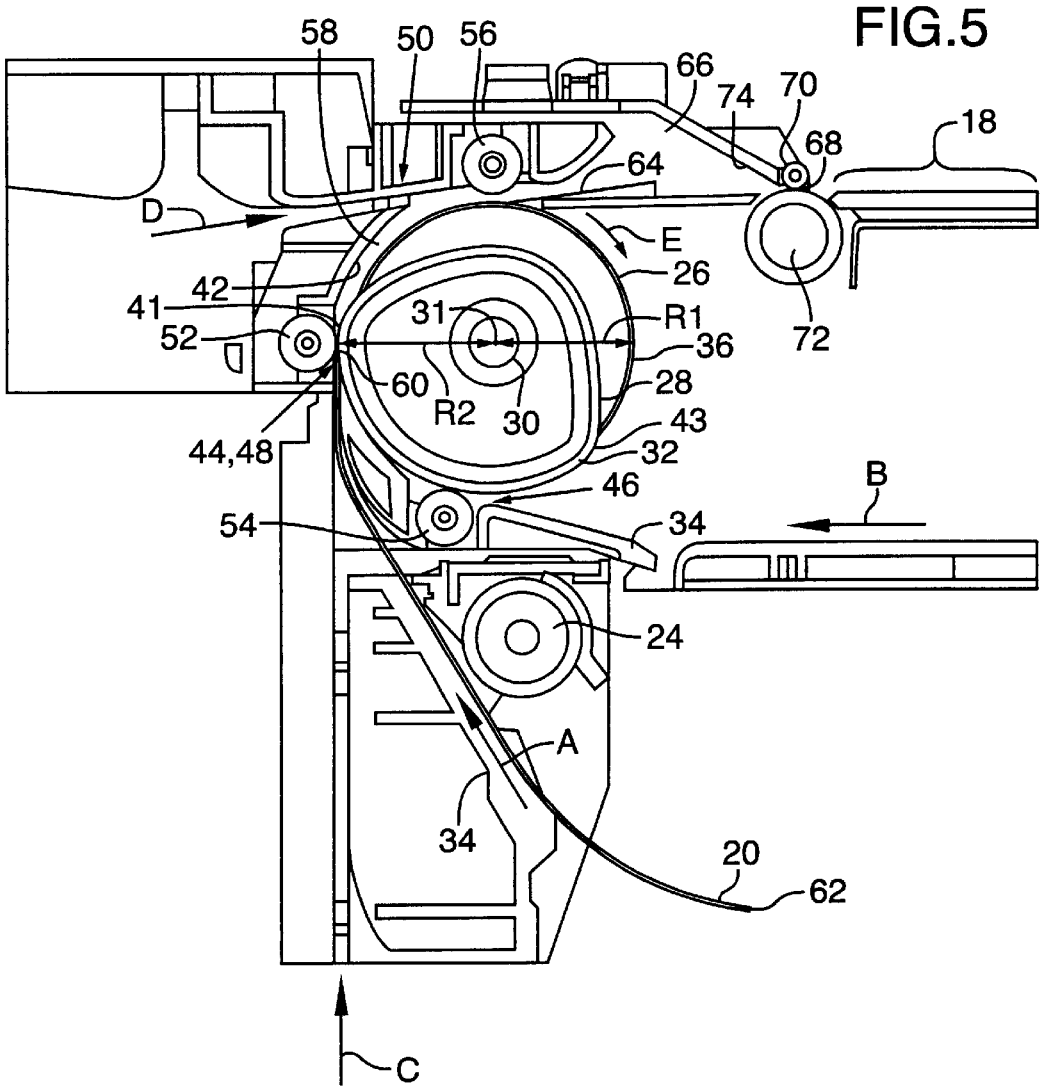

Referring briefly to FIG. 5, although the illustrated embodiment will be detailed with reference specifically to media 20 accepted from lower paper tray 16, it will nonetheless be understood that assembly 12 also may accept media from other input sources, such as a duplexer, which defines a guide path labeled with arrow B, an optional paper tray that defines a guide path labeled with arrow C, and a multi-purpose tray or manual media feed slot that defines a guide path labeled with arrow D. Each of these guide paths defines a path along which media is fed from the respective media source, into the input converger assembly 12. In the input converger assembly the various media guide paths A–D merge into a common guide path that leads to and through the printzone 18. A given printer that embodies the input converger of the present invention may utilize any one or more of the media guide paths A–D described herein.

As illustrated in FIG. 1, lower paper tray 16 is mounted in chassis 14 with appropriate mounts such that paper 20 contained in the tray may be fed to guide path A. Individual sheets of paper 20 are stacked in tray 16 and are picked from the tray in a conventional manner, for example with a driven first pick roller 22 and second pick roller 24, which also is driven. The printer is equipped with appropriate guides 34 to define a clear and unobstructed guide path entrance to path A through the printer.

Converger assembly 12 is illustrated separated from the rest of the printer and in greater detail in FIG. 2. The assembly includes a plurality of guide wheels 26 mounted adjacent a like plurality of drive wheels 28. All of the wheels 26 and 28 are mounted on a shaft 30 that has a central axis 31 (see FIG. 4) that extends transverse to the media feed axis as defined above. The opposite outer ends of shaft 30 are rotatably mounted to chassis 14 and a servomotor that is under the control of the printer controller drives the shaft in a conventional manner, such as with a drive belt or gears. The number of guide wheels illustrated herein is exemplary only, and the converger assembly may be fabricated with a greater or lesser number of wheels. Moreover, the input converger assembly may have different numbers of guide wheels and drive wheels. Further, the structure and function of the guide wheels and drive wheels may be accomplished with a single wheel that combines the structural features of both types of wheels, in which case, however, the combined wheel would likely be fixed to the mounting shaft.

Figure 3:
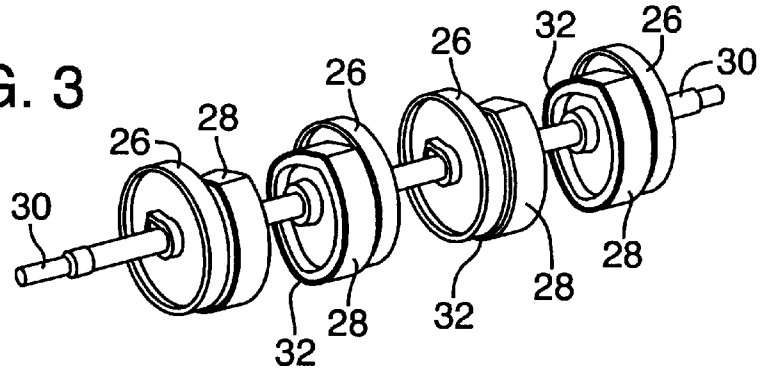
FIG. 3 is a perspective view of the roller assembly utilized with the input converger of FIG. 2.
Figure 4:
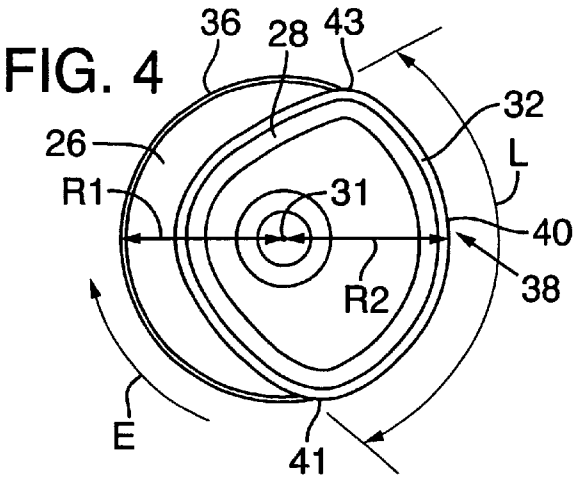
FIG. 4 is a side elevation view of the roller assembly taken along the line 5—5 of FIG. 2, shown in isolation without other parts of the printer shown in FIG. 2.

Referring to FIGS. 2–4, guide wheels 26 are preferably mounted on shaft 30 so that the wheels freely rotate on the shaft with minimal drag. On the other hand, drive wheels 28 are fixedly mounted to shaft 30 so that these wheels rotate directly with the shaft. Guide wheels 26 are typically fabricated from plastic and the surface 36 that defines the outer circumference of the wheels 26 is preferably smooth to minimize, in combination with the manner in which the wheels are mounted for rotation on shaft 30, the frictional drag on paper as it passes over the wheels. Alternately, guide wheels 26 may be fixed to the shaft so that they rotate with it, or cylindrical guides that are not mounted to the shaft and which are independent from it may be used for form the guide wheels. Optionally, the guide wheel surface 36 may be coated with a friction-decreasing material, such as Teflon®.

Drive wheels 28 are friction-type drive wheels that cooperate with pinch rollers (discussed below) to actively advance the media through the converger assembly feed paths A–D and to exit to the printzone 18 via a linefeed roller, as detailed below. As such, the outer, paper-contacting surface of the drive wheels is preferably coated with a friction-enhancing material such as rubber layer 32, or with a grit-coated surface that aids in advancing the media through the input converger.

With reference to FIGS. 3 and 4, guide wheels 26 are preferably circular in outer circumference and define a circle having a radius R1. All of the guide wheels are of the same radial size and the guide wheels define a media guide surface that is separated from axis 31 by the length of RI. Drive wheels 28 are roughly D-shaped and define an extended portion identified with reference number 38 that defines an arc section 40 having a radius R2 that is greater than R1 and which is concentric with the circular outer circumference of guide wheels 26. The length of arc section 40 is defined as arc length L. Arc length L defines an arc that is less than 360°. The specific shape of drive wheel 28 inwardly of extended portion 38 is not important, but in all instances the drive wheel is either smaller in size than guide wheels 26, as illustrated in FIG. 4, or the same circumferential size as wheels 26, except at extended portion 38. As an alternate structure, the drive wheels themselves may be modified such that they function both as the guide wheel and the drive wheel. The combined-function wheel in this case would have one arc section that has a greater radius than the remainder of the wheel, and the remainder of the wheel would function as the guide portion of the wheel.

Shaft 30 and thus drive wheels 28 rotate in the clockwise direction in FIG. 4 (arrow E). Accordingly, the extended portion 38 defines a leading edge 41 and a trailing edge 43 as shaft 30 rotates.

Figure 7:
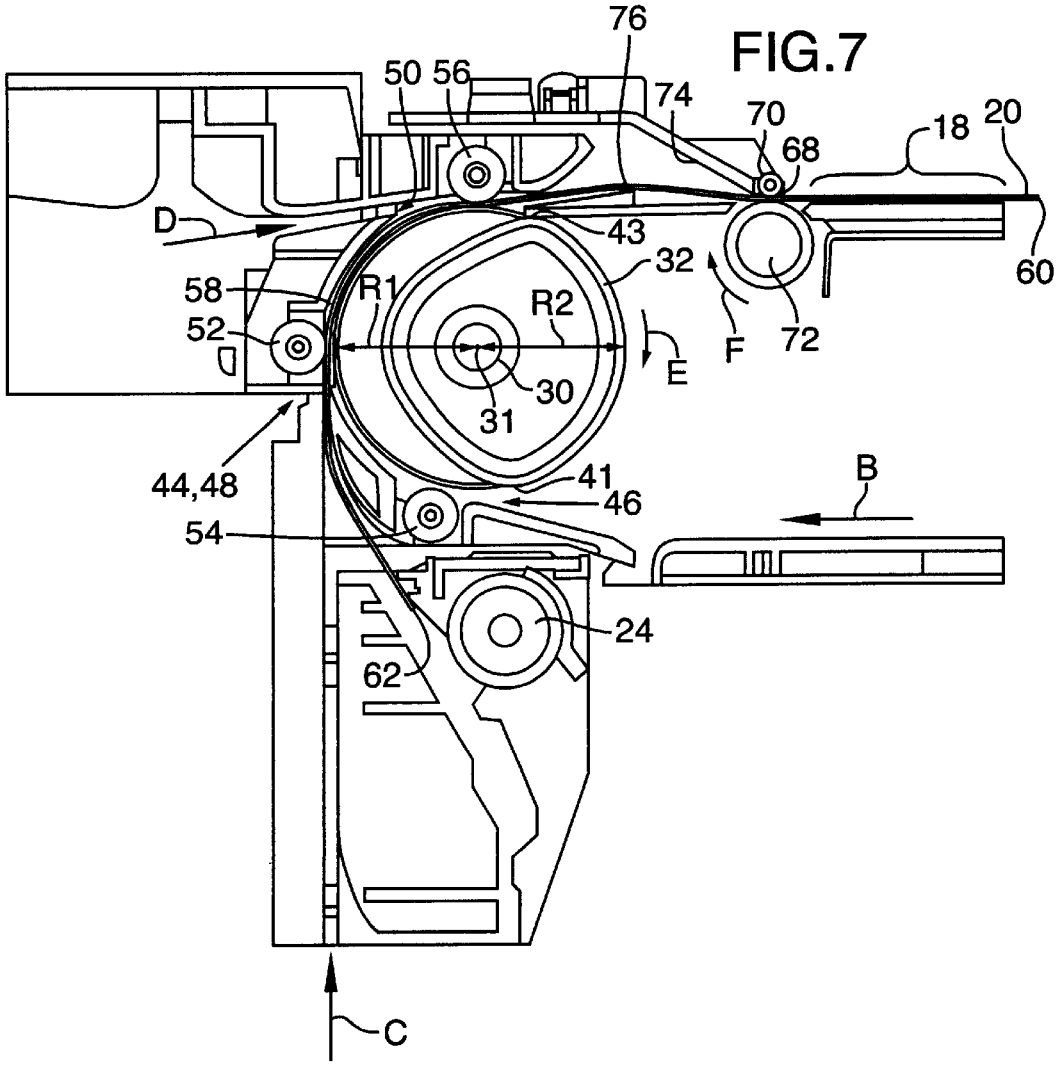

Turning now to FIGS. 5 through 7, the operation of input converger 12 will be detailed by explaining the sequential operation of the converger as media is delivered to the converger along guide path A from lower paper tray 16. As illustrated, media paths B, C and D each intersect a portion of the longest feed path A, so for the purposes of brevity, only path A will be described in detail.

Media 20, which typically is a single sheet of paper, is picked from lower paper tray 16 in a conventional manner (as for example with pick rollers 22 and 24) and is directed into guide path A with the assistance of media guides 34. Pick roller 24 is driven and thus actively advances media 20 in guide path A toward input converger assembly 12. The input converger assembly 12 includes a circumferential media guide surface 42 that is generally concentric with guide wheels 26 and which is spaced apart from the outer surface 36 of the guide wheels to define a common media path 58 therebetween. Associated with each media path (paths A, B, C and D in the embodiment described herein) is an entry point that is defined generally as the position in the media path where media delivered from one of the media sources enters the input converger assembly and the common media path 58, from those portions of the media path that are "upstream" of the entrance to path A, defined by media guides 34. As used herein, "upstream" is used relative to the direction in which media is advancing through the printer. Thus, for example, printzone 18 is downstream from guide surface 42 because media advances through the printer in the direction from guide surface 42 toward printzone 18. For media path A the entry point into the common media path is labeled with reference number 44. For media path B the entry point is labeled with reference number 46. The media path C entry point 48 is the same as the entry point for media path A, even though those two media paths are common for a short distance downstream of point 44, 48. And finally, the entry point for media path D is labeled with reference number 50.

Immediately downstream of each entry point 44–50 just described there are a series of spring loaded pinch rollers that extend along an axis parallel to shaft 30 and which communicate with the common media guide path 58 such that the outer surface of the pinch rollers contacts the extended portion 38 of the drive wheels to thereby form a pinch contact point with the extended portion of the drive wheels 28 when the drive wheels are rotationally oriented relative to the pinch rollers such that the extended portion 38 faces the pinch rollers. Stated another way, radius R2 is slightly greater than the distance between the center of shaft 30 (defined by axis 31) and the outer surface of the pinch rollers, whereas radius R1 is shorter than the same distance. Thus, the pinch rollers and guide wheel surfaces never contact, and instead define therebetween a portion of a media feed path extending from the supply sources of paths A–D to the printzone 18. The pinch rollers associated with media path A and entry point 44 are shown in FIG. 5 as labeled with reference number 52. Pinch rollers 52 are also associated with media path C and its associated entry point 48. Although in the sectional view of FIG. 5 only one pinch roller 52 is shown, it will be appreciated that there is a pinch roller associated with each drive wheel 28. The pinch rollers associated with media path B and entry point 46 are labeled with reference number 54, and the pinch rollers for media path D and entry point 50 are labeled with reference number 56.

The specific sequential series of steps involved in the operation of input converger 12 will now be described beginning with FIG. 5. A sheet of media 20 is picked from paper tray 16 and is advanced with the pick rollers such as roller 24 into media path A. Shaft 30 is rotated in the clockwise direction (arrow E) until leading edge 41 of extended section 38 touches pinch roller 52, at which point shaft rotation is stopped. This results in a stationary pinch formed at the contact point between the leading edge of the extended sections and the pinch rollers. Media 20 is advanced through media path A and through entry point 44 into common media path 58 by pick roller 24. When a leading edge 60 of media 20 enters the pinch between drive wheels 28 and pinch roller 52, shaft 30 begins rotation to capture the leading edge 60 in the pinch. Once the drive wheels have accepted the media, the pick rollers decouple from the media so that advancement of media 20 is accomplished with drive wheels 28.

It should be noted that media 20 is deskewed as the pick rollers decouple from active engagement with the media and media advancement is taken over by the drive wheels.

Turning now to FIG. 6, shaft 30 has continued its rotation about axis 31 in the direction of arrow E. The arc length L of extended section 40 is greater than the length of the arcuate path between the contact point on pinch roller 52 and the contact point on the next sequential pinch roller 56 in common media path 58. Accordingly, as drive wheel 28 rotates with shaft 30, media 20 is continuously pinched between the outer surface of drive wheel 28 in extended section 38 and pinch wheel 52, until such time as the trailing edge 43 of the extended section rotates past pinch wheel 52. Because the arc length L is greater than the arc distance between the contact point on pinch wheel 52 and the next pinch wheel 56, media 20 continues to be advanced through the input converger after trailing edge 43 passes pinch wheel 52, by the pinching pressure exerted on media 20 as it is captured between extended section 38 and pinch wheel 56. The rubber coating 32 on extended section 38 aids in maintaining good driving contact between drive wheel 28 and the media.

Just downstream of pinch wheel 56 the common media guide path 58 is diverted over a guide member 64. The leading edge 60 of media 20 is advanced over guide 64, as illustrated in FIG. 6, and toward a linefeed pinch 68 defined between a linefeed pinch wheel 70 and a driven linefeed roller 72. Immediately upstream of linefeed pinch 68, a ceiling portion of chassis 14 defines an upwardly extending guide 74 that defines an upwardly extending buckle space 66. The linefeed roller 72 remains stationary until the media leading edge 60 is advanced into linefeed pinch 68 across entire width of the media 20. The arc length L of extended section 38 is long enough so that as the media leading edge 60 is entering the stationary pinch, media immediately upstream of the pinch is urged upwardly in buckle space 66 to form a buckle 76. Thus, as the leading edge 60 of media 20 enters pinch 68 and before roller 72 begins rotation to pinch media 20 in pinch 68, shaft 30 continues its clockwise rotation (arrow E), causing the formation of buckle 76. Once the leading edge has entered the stationary pinch across the entire width of the media, linefeed roller 72 begins to rotate to capture the leading edge in the linefeed pinch. Trailing edge 43 of arc section 40 then passes pinch roller 56 and the driving engagement between drive wheel 28 and media 20 is disengaged or decoupled. Linefeed roller 72 continues its rotational movement in the clockwise direction in the figures (arrow F), and takes over the job of advancing media 20 through printzone 18. The arc length L is thus set so that drive wheel 28 hands off media 20 to linefeed roller 72 after buckle 76 is formed in buckle space 66, and media 20 has been accepted into linefeed pinch 68.

If there are any media alignment errors prior to the media being accepted into the linefeed pinch, for instance, if the paper is skewed, those errors are corrected when the drive wheel decouples from pinch roller 56. The linefeed roller does not begin to rotate until the entire leading edge has entered the linefeed pinch (which is parallel to the axis of print carriage movement and perpendicular to the media feed axis). As such, if there is any misalignment in the media, for instance, if the media is oriented so that the leading edge is not perpendicular with the drive axis, then the paper is twisted somewhat when the buckle is formed. After the leading edge has been accepted into the linefeed pinch, the drive wheel decouples from the pinch roller. When this happens the paper is untwisted—that is, deskewed.

Drive wheel 28 continues to rotate in the direction of arrow E so that the drive wheel is in a "home" or "neutral" position, which is defined as the position in which the extended portion 38 is not in contact with any of the pinch wheels, as shown in FIG. 7. In this position the portions of media 20 that are upstream of linefeed roller 72 are dragged over guide wheels 26. As noted earlier, the guide wheels 26 rotate freely on shaft 30 to minimize any frictional forces on media 20 during advancement through printzone 18. Linefeed roller 72 thus is able to pull media 20 and advance it through printzone 18 with very little resistive force.

Linefeed errors, which are those printing errors attributable to media misfeed through printzone 18 as described above, are minimized because the media is being advanced only by the linefeed roller. The deskewing function of buckle 76 as described above minimizes media alignment problems. It will be appreciated that the same sequence of steps occurs regardless of which media guide path (i.e. A, B, C or D) is being used to accept the media into the input converger.

In addition to minimizing or eliminating linefeed errors, the illustrated embodiment of input converger 12 allows tailgating to be used to increase media throughput (which may be defined as the number of sheets of media that can be advanced through the printer over a given period of time, for instance, as a rating expressed in pages per minute). Because drive wheels 28 form a pinch with each set of pinch wheels 52, 54, 56 in a sequence, the leading edge 60 of a second sheet of media may follow the trailing edge 62 of the previous sheet as soon at the trailing edge 62 of the previous sheet leaves an open pinch. Thus, as soon as trailing edge 62 of media 20 passes pinch wheel 52, the leading edge 60 of the next sequential sheet 20 in a print job may enter the pinch between drive wheel 28 and pinch wheel 52.

In addition, by using passive, spring loaded pinch rollers 52, 54 and 56, there is no need to incorporate an active disengaging mechanism such as a transmission-type release. Finally, media jam resolution is simplified by use of passive spring loaded pinch wheels 52, 54, 56 mounted in the converger assembly. When the pinch wheels are mounted directly in the paper guide structures as described herein, removal of the paper guides to provide access to a jammed sheet of paper is much easier, than, for example, in a converger assembly that utilizes a mechanical disengage mechanism.

Although preferred and alternative embodiments of the present invention have been described, it will be appreciated by one of ordinary skill in this art that the spirit and scope of the invention is not limited to those embodiments, but extend to the various modifications and equivalents as defined in the appended claims.

What is claimed is:

1. An input converger for advancing media along a media feed path in a hardcopy device, comprising:

a guide surface;

a cylindrical media guide wheel having a radius R1 mounted on a shaft having a shaft axis extending transverse to a media feed axis defined by the direction of media advancement, the guide wheel and the guide surface spaced apart from one another to define a media feed path therebetween;

a pinch roller having an outer surface communicating with the media feed path;

a drive wheel fixed on the shaft and having an extended portion having radius R2, where R2>R1, the extended portion concentric with the guide wheel.

2. The input converger of claim 1 wherein the cylindrical media guide wheel defines a first circumference and the extended portion of the drive wheel defines an arc length that is less than the 360°.

3. The input converger of claim 1 wherein the extended portion of the drive wheel is coated with rubber.

4. The input converger of claim 1 including plural cylindrical guide wheels, each rotatably mounted on the shaft.

5. The input converger of claim 1 including plural drive wheels, each fixedly mounted to the shaft.

6. The input converger of claim 5 wherein each drive wheel has an extended portion with radius R2.

7. The input converger of claim 6 including plural pinch rollers, each mounted for rotation about an axis parallel to the shaft axis, with each pinch roller cooperating with an associated one of said plural cylindrical guide wheels.

8. The input converger of claim 1 wherein the radius R2 is greater than a distance from the shaft axis to the outer surface of the pinch roller.

9. The input converger of claim 8 wherein the extended portion has a leading edge and a trailing edge defining a length L therebetween.

10. The input converger of claim 9 including a linefeed pinch in the media feed path downstream of the pinch roller, and wherein the distance along the media feed path from the pinch roller to the linefeed pinch is less than the length L.

11. The input converger of claim 10 including a guide member defining a buckle space between the pinch roller and the linefeed pinch.

12. The input converger of claim 11 including plural media sources, each located upstream of the drive wheel and including plural pinch rollers, each cooperating with an associated one of said plural media sources.

13. The input converger of claim 10 wherein the distance between adjacent pinch rollers is less than the length L.

14. The input converger of claim 13 wherein the media is pinched between the leading edge and trailing edge of the extended portion of the drive wheel and the pinch roller to advance the media along the feed path as the drive wheel rotates.

15. The input converger of claim 14 wherein the media is released from the drive wheel when the trailing edge of the extended portion rotates past the pinch roller.

16. The input converger of claim 15 wherein the distance between the linefeed pinch and the adjacent pinch roller is less than length L.

17. The input converger of claim 16 wherein the media is buckled between the linefeed pinch and an adjacent pinch roller prior to the media being decoupled from the drive wheel as the shaft rotates.

18. A method of deskewing media taken from a selected one of plural media sources as the media is advanced through a hardcopy device, the method comprising:

(a) advancing the media through a feed path defined between a media guide and a cylindrical guide wheel having a radius R1, by pinching the media between an extended portion of a rotating drive wheel and a pinch roller that communicates with the feed path, wherein the extended portion defines a radius R2 that is greater than R1 and the extended portion defines an arc having a length L;

(b) advancing a leading edge of the media to a linefeed pinch between a driven linefeed roller and a linefeed pinch wheel, the linefeed pinch separated from the pinch roller by a distance less than length L;

(c) buckling the media between the linefeed pinch and the pinch roller;

(d) disengaging the drive wheel from the pinch roller to depinch the media from the drive wheel after the media leading edge has entered the linefeed pinch.

19. The method of claim 18 including the step of advancing the media with the linefeed roller after said disengaging.

20. An input converger for advancing a sheet of media along a media feed path in a hardcopy device, comprising:

a guide surface defining a portion of the media feed path;

plural drive wheels, each fixed to a shaft having a shaft axis extending transverse to a media feed axis that is defined by the direction of media advancement and each having an extended portion defining a partial radial section having radius R2;

plural pinch rollers, one associated with each drive wheel, and each mounted for rotation about an axis parallel to the shaft axis and having an outer surface communicating with the media feed path, and each pinch roller having an outer surface separated from the shaft axis by a distance less than R2.

21. The input converger of claim 20 including plural cylindrical guide wheels rotatably mounted on the shaft and each having a radius R1, where R1<R2.

22. The input converger of claim 21 where the extended portion of each drive wheel is concentric with the cylindrical guide wheels.

23. The input converger of claim 22 wherein the length of the arc defined by the partial radial section is L, and including a linefeed pinch adjacent the pinch rollers and separated therefrom by a distance less than L.

24. An input converger for advancing media through a hardcopy device, comprising:

guide surface means for defining a portion of a media feed path;

media guide wheel means for defining a portion of the media feed path and having a radius R1, said media guide wheel means mounted on a shaft having a shaft axis extending transverse to a media feed axis defined by the direction of media advancement, the media guide wheel means and the guide surface means spaced apart from one another to define a media feed path therebetween;

pinching means mounted for rotation about an axis parallel to the shaft axis and having an outer surface for communicating with the media feed path; and media drive wheel means fixed on the shaft and having an extended portion configured for contacting the pinch roller.

25. The input converger of claim 24 wherein the media drive wheel means further comprises an extended portion defining a radius R2, where R2>R1, and wherein the extended portion is concentric with the media guide wheel means.

26. A hardcopy device, comprising:

a frame defining a media interaction zone;

a supply source of media; and a media advancement mechanism comprising:

a guide surface;

a cylindrical media guide wheel defining a first radius and mounted on a shaft having a shaft axis transverse to a media feed axis defined by the direction of media advancement, the guide wheel and the guide surface defining a media feed path therebetween;

a pinch roller having an outer surface communication with the media feed path;

a drive wheel fixed on the shaft and having an extended portion having a radius greater than the first radius, wherein the extended portion is concentric with the guide wheel.

27. The hardcopy device according to claim 26 wherein the extended portion defines a partial radial section having an arc length less than 360°.

28. The hardcopy device according to claim 26 including plural supply sources of media.

29. The hardcopy device according to claim 28 wherein the extended portion defines a leading edge and a trailing edge defining a length L therebetween.

30. The hardcopy device according to claim 29 including a linefeed pinch in the media feed path adjacent the pinch roller, wherein a distance along the media feed path between the linefeed pinch and the pinch roller is less than L.

31. The hardcopy device according to claim 30 including plural drive wheels, each fixedly mounted to the shaft and each having and extended portion with a radius greater than the first radius.

32. The hardcopy device according to claim 30 including plural cylindrical guide wheels, each rotatably mounted on the shaft and each defining said first radius.

* * * * *

UNITED STATES PATENT AND TRADEMARK OFFICE

CERTIFICATE OF CORRECTION

PATENT NO. : 6,655,679 B2
DATED : December 2, 2003
INVENTOR(S) : Peter Bouchet et al.

It is certified that error appears in the above-identified patent and that said Letters Patent is hereby corrected as shown below:

Column 9,
Line 44, delete “claim 11” and insert therefor -- claim 10 --
Line 48, delete “claim 10” and insert therefor -- claim 12 --

Column 12,
Line 13, delete “and” and insert therefor -- an --

Signed and Sealed this

Eleventh Day of January, 2005

JON W. DUDAS
*Director of the United States Patent and Trademark Office*